US008904663B2

(12) United States Patent
Worgull et al.

(10) Patent No.: US 8,904,663 B2
(45) Date of Patent: Dec. 9, 2014

(54) HAND HAIR DRYER WITH TWO HANDLE GRIPS

(75) Inventors: Klaus Worgull, Darmstadt (DE); Robert Kuechler, Moerfelden-Waldorf (DE)

(73) Assignee: The Procter & Gamble Company, Cincinnati, OH (US)

( * ) Notice: Subject to any disclaimer, the term of this patent is extended or adjusted under 35 U.S.C. 154(b) by 2199 days.

(21) Appl. No.: 10/563,392

(22) PCT Filed: Jul. 26, 2004

(86) PCT No.: PCT/EP2004/008360

§ 371 (c)(1),
(2), (4) Date: Jun. 20, 2007

(87) PCT Pub. No.: WO2005/009171

PCT Pub. Date: Feb. 3, 2005

(65) Prior Publication Data

US 2008/0040943 A1 Feb. 21, 2008

(30) Foreign Application Priority Data

Jul. 24, 2003 (DE) ..... 103 33 586

(51) Int. Cl.
*A45D 20/10* (2006.01)
*A45D 20/12* (2006.01)

(52) U.S. Cl.
CPC ..... *A45D 20/12* (2013.01); *A45D 20/10* (2013.01)
USPC ..... 34/97; 34/96

(58) Field of Classification Search
USPC ..... 34/96, 97, 98, 101; 392/383, 384, 385; 200/49, 50.35, 538, 552, 553
See application file for complete search history.

(56) References Cited

U.S. PATENT DOCUMENTS

| | | | | | |
|---|---|---|---|---|---|
| 3,261,107 | A | | 7/1966 | Ponczek | |
| 3,612,824 | A | * | 10/1971 | Berryman et al. | 392/383 |
| 4,019,260 | A | * | 4/1977 | Levy et al. | 34/97 |
| 4,195,217 | A | * | 3/1980 | Moller et al. | 392/384 |
| 4,198,557 | A | * | 4/1980 | Crowley | 392/384 |
| 4,232,454 | A | * | 11/1980 | Springer | 34/97 |
| 4,629,864 | A | * | 12/1986 | Wilson | 392/385 |
| 4,676,260 | A | * | 6/1987 | Paulhus et al. | 132/212 |
| 4,711,988 | A | * | 12/1987 | Thaler et al. | 392/379 |
| 5,155,925 | A | * | 10/1992 | Choi | 34/97 |
| 5,195,164 | A | | 3/1993 | Lambert | |
| 5,349,147 | A | * | 9/1994 | Gallone | 200/552 |
| 5,467,540 | A | * | 11/1995 | Bastien | 34/97 |

(Continued)

FOREIGN PATENT DOCUMENTS

| | | | | |
|---|---|---|---|---|
| DE | 199 63 112 | | 12/2000 | |
| EP | 1 086 631 | | 3/2001 | |
| JP | 03 009 703 A | * | 1/1991 | A45D 20/10 |

*Primary Examiner* — Kenneth Rinehart
(74) *Attorney, Agent, or Firm* — James T. Fondriest

(57) ABSTRACT

The invention relates to a hand hair dryer (1), comprising an electric fan (2) and an in-series electric heating device (3), for the generation of an air stream (4) out of a tube section (5), whereby the fan (2) is arranged in a housing section (6) and the heating device (3) arranged in the tube section (6). An operating element (7), with a first handle grip (8), is arranged on the housing section (6) at approximately 90 degrees to the tube section (5). The tube section (5) is embodied as a second handle grip (9), thus providing ergonomic advantages on operating the hand hair dryer (1).

10 Claims, 5 Drawing Sheets

(56) References Cited

U.S. PATENT DOCUMENTS

| | | | | |
|---|---|---|---|---|
| 5,555,637 | A | 9/1996 | Montagnino | |
| 5,727,331 | A * | 3/1998 | Thaler et al. | 34/97 |
| 5,875,562 | A * | 3/1999 | Fogarty | 34/97 |
| D455,859 | S * | 4/2002 | Lai | D28/13 |
| 6,671,460 | B1 | 12/2003 | Smal | |
| D502,783 | S * | 3/2005 | Yeung | D28/13 |
| 2004/0006885 | A1 * | 1/2004 | Altamore et al. | 34/60 |
| 2004/0159002 | A1 * | 8/2004 | Carlucci et al. | 34/96 |
| 2004/0231180 | A1 * | 11/2004 | Tang et al. | 34/96 |
| 2005/0198853 | A1 * | 9/2005 | Cafaro | 34/96 |
| 2007/0047930 | A1 * | 3/2007 | Cafaro | 392/385 |

* cited by examiner

HAND HAIR DRYER WITH TWO HANDLE GRIPS

CROSS-REFERENCE TO RELATED APPLICATIONS

This application is the National Stage Entry of PCT/EP04/08360, filed Jul. 26, 2004 and claims priority under 35 U.S.C. 119(a)-(d) to German Patent Application DE 1033358862, filed Jul. 24, 2003.

BACKGROUND OF THE INVENTION

1. Field of the Invention

The invention relates to a hand hair dryer.

2. Description of Related Art

One such hand hair dryer is known for instance from European Patent Disclosure EP 1086631 A1, which is provided with an electric fan and an electric heater, located in line with it, for generating an air stream from a barrel portion. The fan is located in a housing portion, and the heater is located inside the barrel portion. A handle grip that has operator control elements (switches) is located on the housing portion, at an angle of approximately 90° to the barrel portion. When the stylist is holding the dryer with one hand on the handle grip, he can use the operator control elements to set a certain type of drying with a defined temperature level and fan level; typically, these levels are rarely changed during a treatment period. To improve the stability (conditioning) of a section of hair, formed with a brush, cold air from the fan is briefly blown at this section; for that purpose the heater is briefly switched off via a cold air switch. In certain positions for holding the hand hair dryer, the hand hair dryer cannot be handled ergonomically.

BRIEF SUMMARY OF THE INVENTION

This object is attained by the characteristic of the definitive body of claim 1. Advantageous refinements of the invention are defined by the dependent claims.

The invention will be described in further detail in terms of an exemplary embodiment.

DETAILED DESCRIPTION OF THE INVENTION

Figure 1:
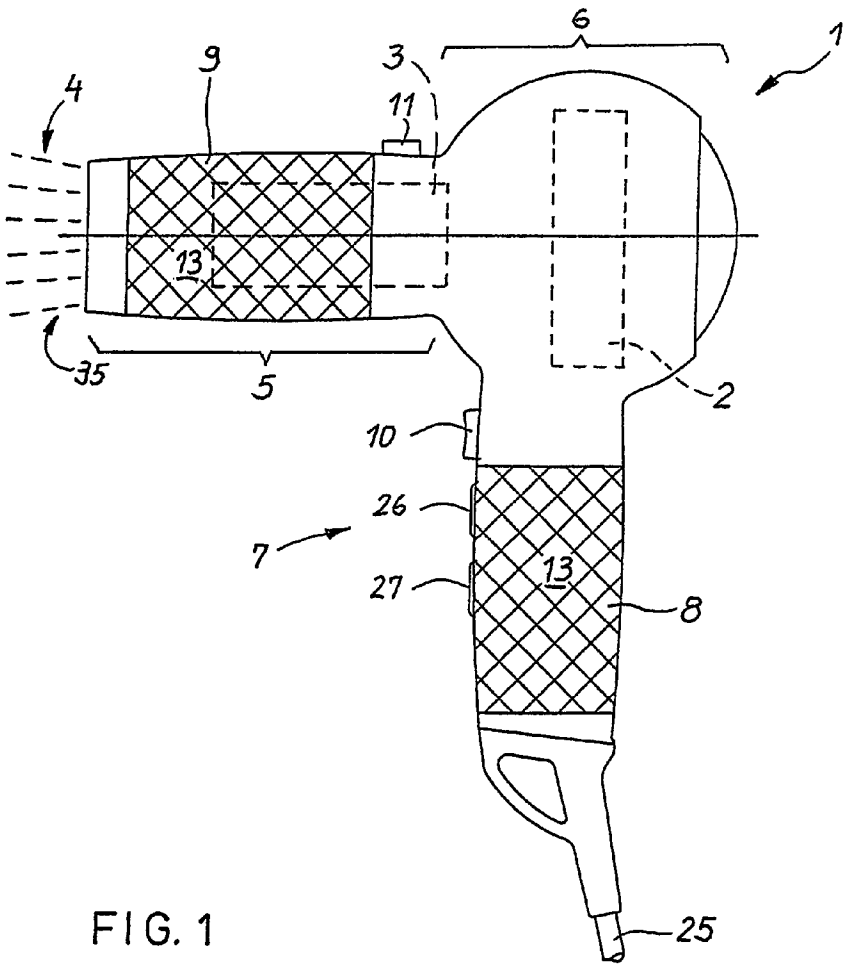
FIG. 1, in a side view, a hand hair dryer with a first and a second handle grip.

FIG. 1 shows a hand hair dryer 1 with an electric fan 2 and with an electric heater 3, located in line with it, for generating an air stream 4 from a barrel portion 5; the fan 2 is located in a housing portion 6, and the heater 3 is located inside the barrel portion 5. A first handle grip 8, which has operator control elements 7 (fan speed switch 26, heat level switch 27) is located on the housing portion 6, at an angle of approximately 90° to the barrel portion 5. The barrel portion 5 is embodied as a second handle grip, which has approximately the same diameter (dimensioning) as the first handle grip 8. As a result, when the hand hair dryer 1 is being used, it can selectively be held by the second handle grip 9 instead, which makes for an ergonomic improvement in manipulating the hand hair dryer 1, as can be seen for instance from FIGS. 2 through 5.

The second handle grip 9 is embodied as heat-insulated (see also FIG. 9), and as a result cannot become hot (cold handle grip zone).

Alternatively or in addition, the barrel portion 5 can be embodied as heat-insulated from outside, and as a result the second handle grip 9 cannot get hot.

The second handle grip 9 is shaped cylindrically, resulting in simple grasping and holding.

Selectively, the first and second handle grips 8, 9 are each provided with a nonslip surface 13. This makes for a secure grip when holding the hand hair dryer 1.

A first cold air switch 10 is located on the first handle grip 8, and a second cold air switch 11 is located on the second handle grip 9. The second cold air switch 11 is located in the vicinity 12 of, or inside, the housing portion 6. As a result, even when holding the second handle grip 9, ergonomic operation of the second cold air switch 11 is obtained. The cold air switches 10, 11 are preferably provided in the form of pushbuttons 10, 11. By actuation of a given cold air switch 10, 11, a power supply to the heater 3 is interrupted, so that only the cold air 31 (FIG. 9) from the fan 2 emerges from the air stream outlet 35.

Figure 2:
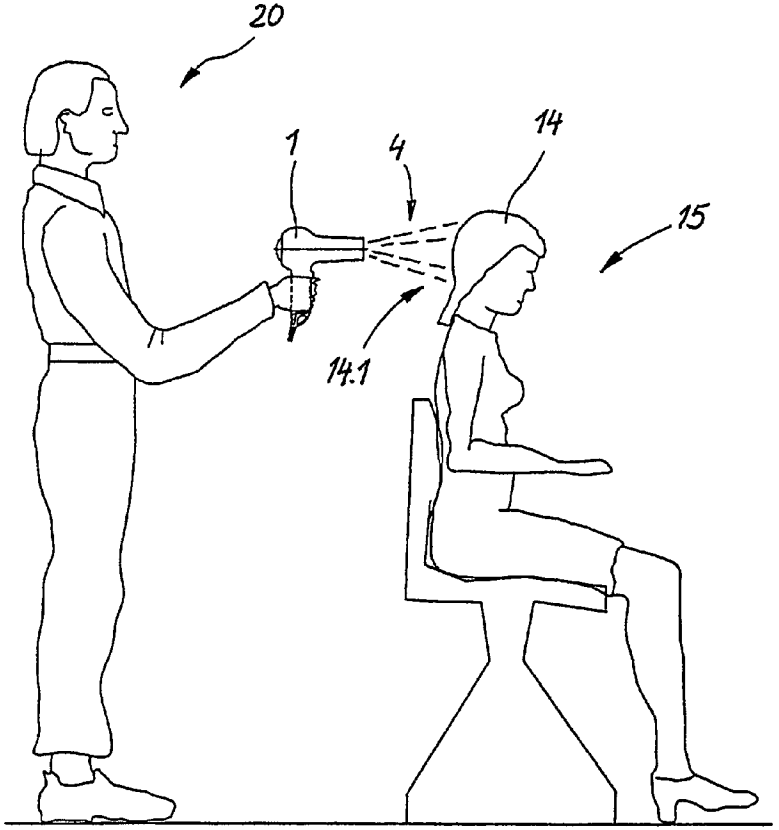
FIG. 2, a typical manipulating position using the first handle grip of a hand hair dryer, when a stylist is treating the hair on one side of the head with an air stream.

FIG. 2 shows a typical manipulating position using the first handle grip 8 of a hand hair dryer 1 when a stylist 20 is treating hair 14 in a rear hair region 14.1 with an air stream.

Figure 3:
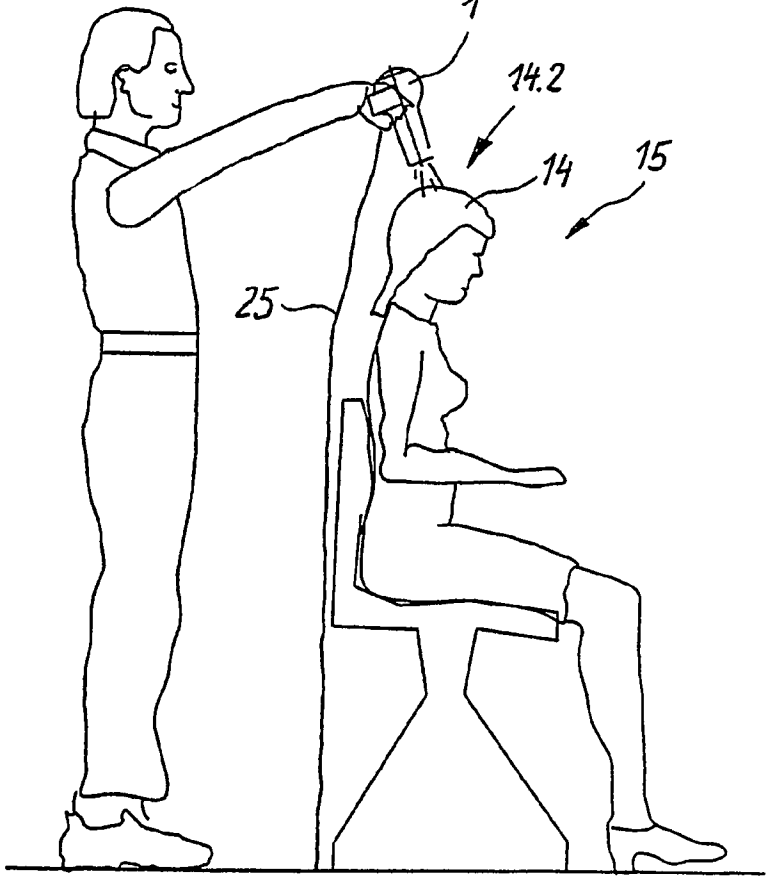
FIG. 3, a typical manipulating position with the first handle grip of a hand hair dryer when a stylist is treating the hair on top of the head with an air stream.

FIG. 3 shows a typical manipulating position at the first handle grip 8 of a hand hair dryer 1 when hair 14.2 on top of the head is being treated with an air stream by a stylist 20. The unfavorable posture of the arm of the stylist 20 is clearly apparent. A power cord 25 moreover extends unfavorably close to the person 15 here.

Figure 4:
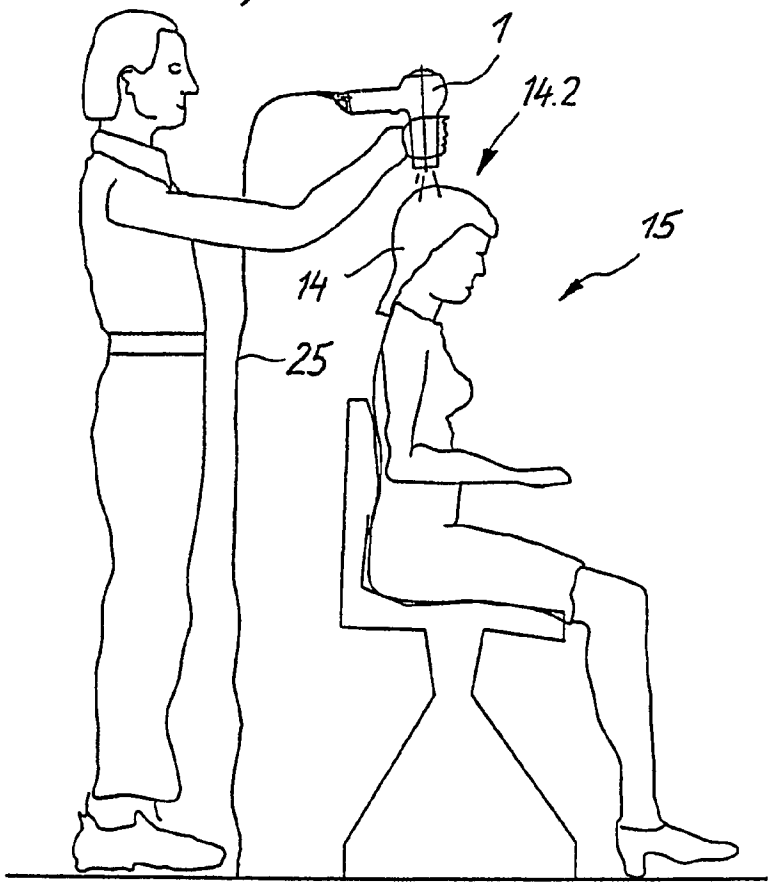
FIG. 4, unlike FIG. 3, an ergonomic advantage in manipulating the hand hair dryer using a second handle grip of the hand hair dryer.

FIG. 4, in a distinction to FIG. 3, shows an ergonomic advantage in manipulating the hand hair dryer 1 by using a second handle grip 9 of the hand hair dryer 1. Here the low arm position of the stylist 20, which is more ergonomically favorable, can be clearly seen. Moreover, the power cord 25 extends more favorably away from the person 15.

Figure 5:
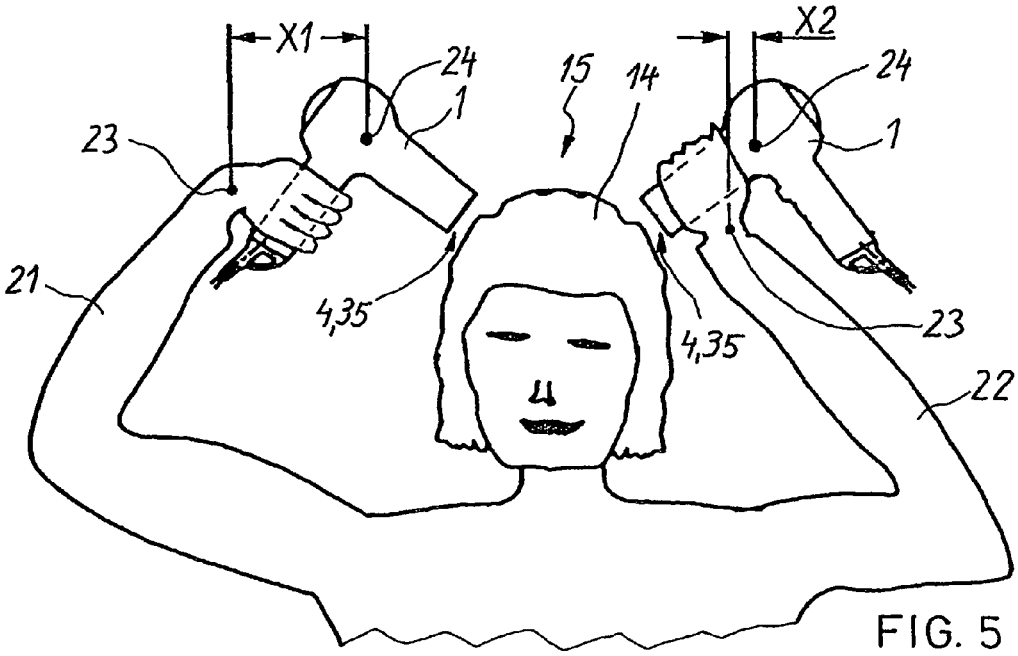
FIG. 5, an ergonomic difference where a person is drying her own hair with a hand hair dryer which has a first and a second handle grip.

FIG. 5 shows an ergonomic distinction in when a person is drying her own hair with a hand hair dryer 1 that has a first and a second handle grip 8, 9. Two essential distinctions are clearly visible, for the same positioning of the hand hair dryer 1 relative to the hair 14.

1. When the hand hair dryer 1 is held by the first handle grip 8, the right arm 21 must be held markedly higher than the left arm 22 when the hand hair dryer 1 is held by the second handle grip 9.

2. Because there is a greater distance X1 between a wrist point 23 and a center of gravity 24 of the hand hair dryer 1, it is harder to hold the hand hair dryer 1. It is also difficult to keep an intended distance between an air outlet 25 and the hair 14. By means of a smaller distance X2 between a wrist point 23 and a center of gravity 24 of the hand hair dryer 1, holding the hand hair dryer 1 is ergonomically more advantageous, and it is easier to keep an intended distance between the air outlet 25 and the hair 14.

Figure 6:
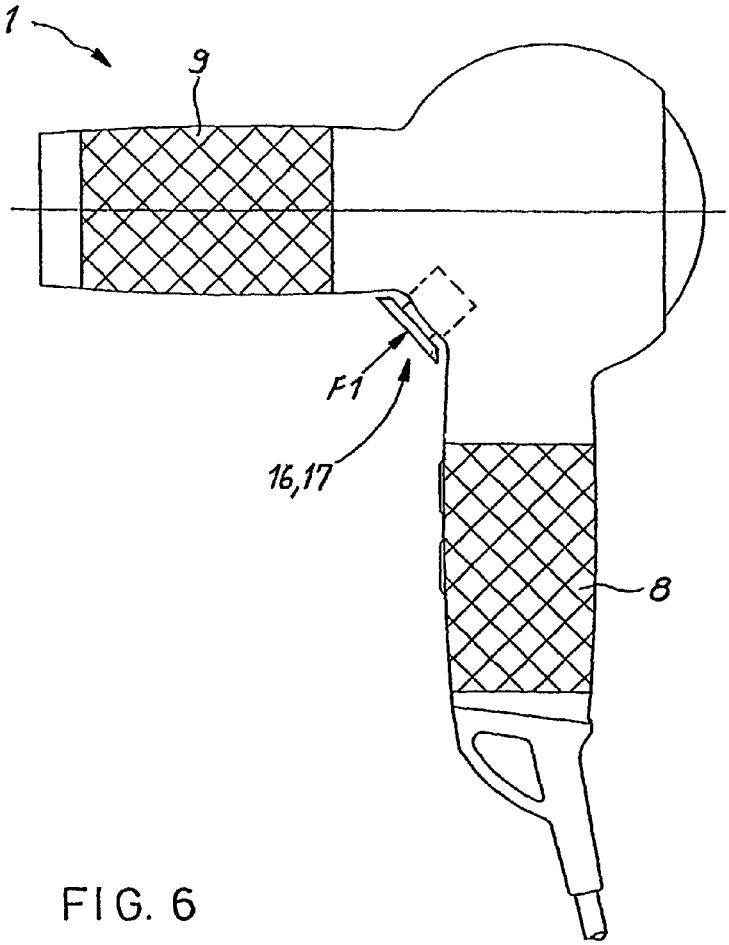
FIG. 6, in a side view, a hand hair dryer as in FIG. 1, but with a first cold air combination switch.

FIG. 6, in a side view, shows a hand hair dryer 1 of FIG. 1, but with a first cold air combination switch 16, which is located between the first and second handle grips 8, 9. As the first cold air combination switch 16, a pushbutton 17 is provided here, which can be actuated with one finger (F1) selectively from the first or second handle grip 8, 9. As a result, a second cold air switch 11 is dispensed with.

Figure 7:
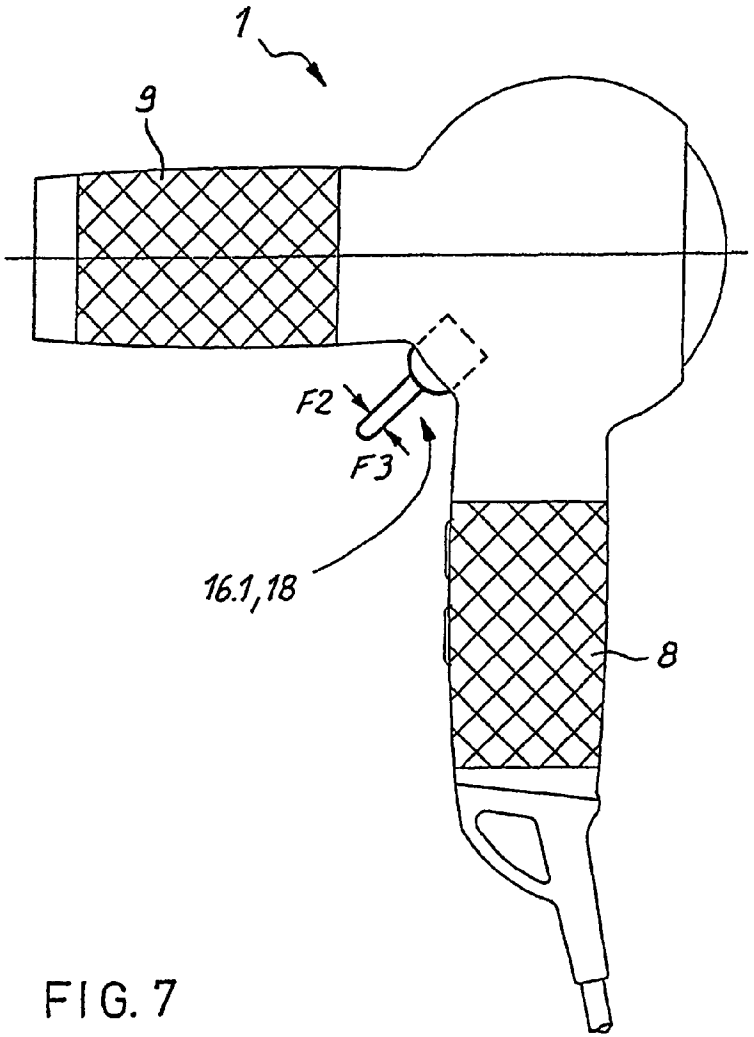
FIG. 7, in a side view, a hand hair dryer as in FIG. 1, but with a second cold air combination switch.

FIG. 7, in a side view, shows a hand hair dryer 1 of FIG. 1, but with a second cold air combination switch 16.1, which is located between the first and second handle grips 8, 9. Here, a one-legged toggle switch 18 is provided as the second cold air combination switch 16.1; it can be actuated selectively from the first or second handle grip 8, 9, using one finger (F2, F3). As a result, a second cold air switch 11 is dispensed with.

Figure 8:
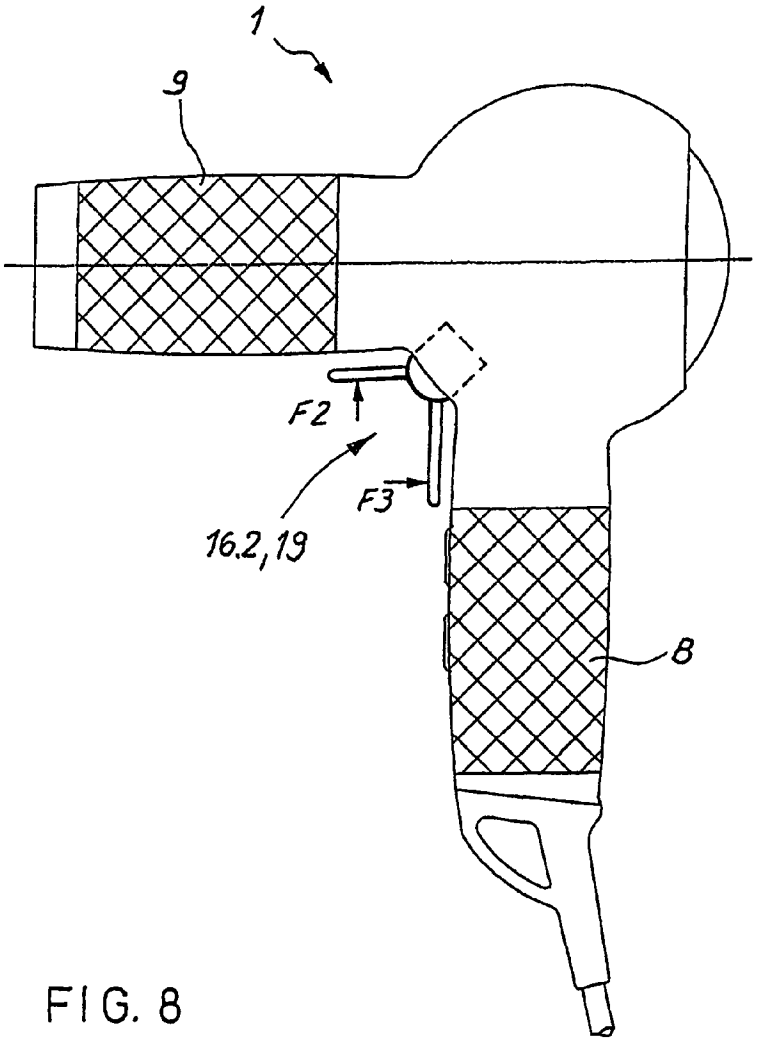
FIG. 8, in a side view, a hand hair dryer as in FIG. 1, but with a third cold air combination switch.

FIG. 8, in a side view, shows a hand hair dryer 1 of FIG. 1, but with a second cold air combination switch 16.1, located between the first and second handle grips 8, 9. Here, a two-armed (V-shaped) toggle switch 19, is provided as the third cold air combination switch 16.2; it can be actuated selectively from the first or second handle grip 8, 9, using one finger (F2, F3). As a result, a second cold air switch 11 is dispensed with.

Figure 9:
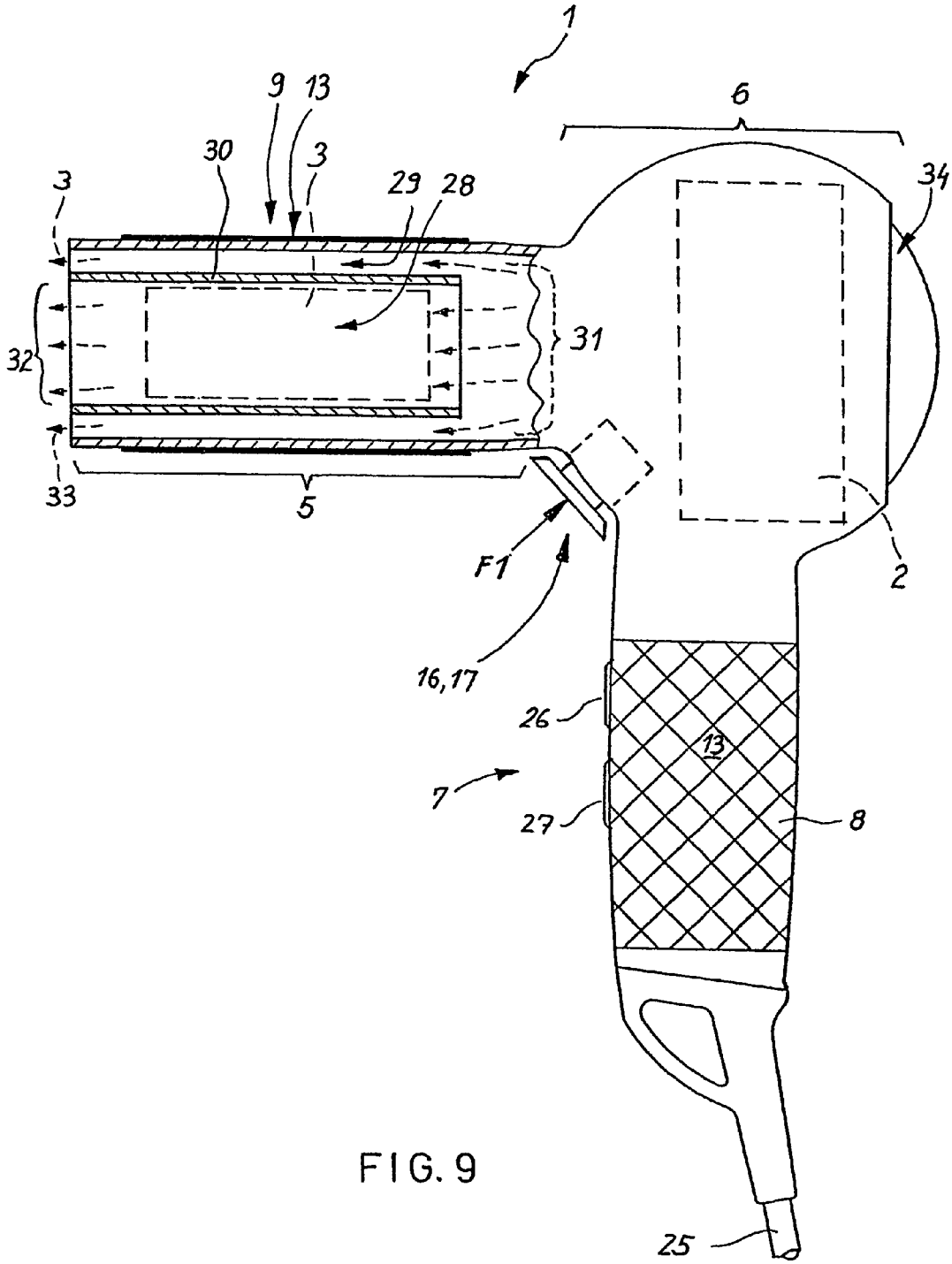
FIG. 9, in a side view, a hand hair dryer as in FIG. 6, but with a second handle grip that remains cold.

In FIG. 9, compared to the hand hair dryer 1 of FIG. 6, an especially advantageous hand hair dryer 1 is shown, in which the second handle grip 9 remains especially cool because a centrally located warm-air conduit 28 and a coaxial cold-air conduit 29 are provided in the barrel portion 5. The central warm-air conduit 28 is formed by a hollow-cylindrical barrel 30, in which the heater 3 is located. The coaxial cold-air conduit 29 is formed by the barrel portion 5 and the central warm-air conduit 28. The central warm-air conduit 28 and the coaxial cold-air conduit 29 are subjected to a cold air stream 31 of the fan 2, and by means of the heater 3, a warm air stream outlet 32 from the central warm-air conduit 28 and a cold air stream 33 from the coaxial cold-air conduit 29 are effected, and the constant cold air stream 31 in the coaxial cold-air conduit 29 makes for a cool second handle grip 9.

LIST OF REFERENCE NUMERALS

1 Hand hair dryer
2 Fan
3 Heater
4 Air stream
5 Barrel portion
6 Housing portion
7 Operator control elements
8 First handle grip
9 Second handle grip
10 First cold air switch
11 Second cold air switch
12 Vicinity of housing portion 6
13 Nonslip surface
14 Hair
14.1 Rear hair region
14.2 Hair on top of the head
15 Person
16 First cold air combination switch
16.1 Second cold air combination switch
16.2 Third cold air combination switch
17 Pushbutton
18 One-legged toggle switch
19 Two-legged toggle switch
20 Hair stylist
21 Right arm
22 Left arm
23 Right wrist point
24 Left wrist point
25 Power cord
26 Fan speed switch
27 Heat level switch
28 Central warm-air conduit
29 Coaxial cold-air conduit
30 Barrel
31 Cold air stream/fan 2
32 Warm air stream outlet
33 Cold air stream outlet
34 Air intake region
35 Air stream outlet
F1-3 Switch actuation direction
X1, X2 Distance between wrist point and center of gravity of hand hair dryer

The invention claimed is:

1. A hand hair dryer (1) comprising:
an electric fan (2) located in a housing portion (6);
a first handle grip (8) comprising operator control elements (7) and connected to the housing portion (6); and
a barrel portion (5) containing an electric heater (3) and connected to the housing portion (6) at an angle of approximately 90° with respect to said first handle grip (8) wherein:
said electric heater (3) is located in line with said electric fan (2) for generating an air stream (4) from said barrel portion (5);
said barrel portion (5) is embodied as a second handle grip (9) that is insulated from the heater (3) to prevent said second handle grip (9) from getting hot during use;
a single cold air combination switch (16, 16.1, 16.2) is located only on the housing portion (6) between said first handle grip (8) and said barrel portion (5) at the angle formed by the first handle grip (8) and the barrel portion (5); and
said cold air combination switch (16, 16.1, 16.2) is configured to be actuated selectively from the first or second handle grip (8, 9), by direct contact between the cold air combination switch and one finger of a hand on either the first handle grip (8) or the second handle grip (9).

2. The hand hair dryer in accordance with claim 1, wherein the barrel portion (5) is heat-insulated from the outside.

3. The hand hair dryer in accordance with claim 1, wherein the second handle grip (9) and the barrel portion (5) are embodied as heat-insulated from the outside.

4. The hand hair dryer in accordance with claim 1, wherein the second handle grip (9) is shaped cylindrically.

5. The hand hair dryer in accordance with claim 1, wherein the first and second handle grips (8, 9) are each provided with a nonslip surface (13).

6. The hand hair dryer in accordance with claim 1, wherein the cold air combination switch (16) is a pushbutton (17).

7. The hand hair dryer in accordance with claim 1, wherein the cold air combination switch (16.1) is a one-legged toggle switch (18).

8. The hand hair dryer in accordance with claim 1, wherein the cold air combination switch (16.2) is a two-legged toggle switch (19).

9. The hand hair dryer in accordance with claim 1, wherein:

a centrally located warm-air conduit (28) and a coaxial cold-air conduit (29) are provided in the barrel portion (5);

the central warm-air conduit (28) is formed by a hollow-cylindrical barrel (30), in which the heater (3) is located;

the coaxial cold-air conduit (29) is formed by the barrel portion (5) and the hollow-cylindrical barrel (30); and the central warm-air conduit (28) and the coaxial cold-air conduit (29) are acted upon by a cold air stream (31) of the fan (2) and, by means of the heater (3), a warm air stream outlet (32) is effected out of the central warm-air conduit (28), and a cold air stream outlet (33) is effected from the coaxial cold-air conduit (29).

10. A hand hair dryer (1) comprising:

an electric fan (2) located in a housing portion (6);

a first handle grip (8) comprising operator control elements (7) and connected to the housing portion (6); and a barrel portion (5) containing an electric heater (3) and connected to the housing portion (6) at an angle of approximately 90° with respect to said first handle grip (8) wherein:

said electric heater (3) is located in line with said electric fan (2) for generating an air stream (4) from said barrel portion (5);

said barrel portion (5) is embodied as a second handle grip (9);

a single cold air combination switch (16, 16.1, 16.2) is located only on the housing portion (6) between said first handle grip (8) and said barrel portion (5) at the angle formed by the first handle grip (8) and the barrel portion (5);

said cold air combination switch (16, 16.1, 16.2) is configured to be actuated selectively from the first or second handle grip (8, 9), by direct contact between the cold air combination switch and one finger of a hand on either the first handle grip (8) or the second handle grip (9);

a centrally located warm-air conduit (28) and a coaxial cold-air conduit (29) are provided in the barrel portion (5);

the central warm-air conduit (28) is formed by a hollow-cylindrical barrel (30), in which the heater (3) is located;

the coaxial cold-air conduit (29) is formed by the barrel portion (5) and the hollow-cylindrical barrel (30); and the central warm-air conduit (28) and the coaxial cold-air conduit (29) are acted upon by a cold air stream (31) of the fan (2) and, by means of the heater (3), a warm air stream outlet (32) is effected out of the central warm-air conduit (28), and a cold air stream outlet (33) is effected from the coaxial cold-air conduit (29).

* * * * *